US012048333B2

(12) United States Patent
Bologna et al.

(10) Patent No.: US 12,048,333 B2
(45) Date of Patent: Jul. 30, 2024

(54) CLEANING TOOL WITH ADDITIONAL CLEANING ELEMENTS FOR AN AEROSOL-GENERATING DEVICE

(71) Applicant: PHILIP MORRIS PRODUCTS S.A., Neuchatel (CH)

(72) Inventors: Matteo Bologna, Lausanne (CH); Ferdinando Carignani, Naples (IT)

(73) Assignee: Philip Morris Products S.A., Neuchatel (CH)

( * ) Notice: Subject to any disclaimer, the term of this patent is extended or adjusted under 35 U.S.C. 154(b) by 316 days.

(21) Appl. No.: 17/760,849

(22) PCT Filed: Sep. 17, 2020

(86) PCT No.: PCT/EP2020/076054
§ 371 (c)(1),
(2) Date: Mar. 16, 2022

(87) PCT Pub. No.: WO2021/053120
PCT Pub. Date: Mar. 25, 2021

(65) Prior Publication Data

US 2022/0338553 A1 Oct. 27, 2022

(30) Foreign Application Priority Data

Sep. 20, 2019 (EP) ..... 19198518

(51) Int. Cl.
*A24F 40/85* (2020.01)

(52) U.S. Cl.
CPC ..... *A24F 40/85* (2020.01)

(58) Field of Classification Search
None
See application file for complete search history.

(56) References Cited

FOREIGN PATENT DOCUMENTS

| | | |
|---|---|---|
| CH | 237833 | 5/1945 |
| CN | 201752712 U | 3/2011 |
| EP | 2201850 | 6/2010 |
| GB | 602517 | 5/1948 |
| IT | B020130031 | 7/2014 |
| JP | 2012-513750 | 6/2012 |
| WO | WO 2016/124550 | 8/2016 |
| WO | WO 2019/175104 | 9/2019 |

OTHER PUBLICATIONS

PCT Search Report and Written Opinion for PCT/EP2020/076054 dated Nov. 2, 2020 (12 pages).
Office Action issued in China for Application No. 202080060769.6 dated Jan. 4, 2024 (13 pages). English translation included.
Office Action issued in Japan for Application No. 2022-517480 dated Jan. 10, 2023 (4 pages). English translation included.

*Primary Examiner* — Phu H Nguyen
(74) *Attorney, Agent, or Firm* — Mueting Raasch Group

(57) ABSTRACT

The cleaning system for an aerosol-generating device comprises a first cleaning tool comprising a cleaning body having a cleaning head, and a housing configured to house at least part of the cleaning body. The housing is formed by a first cap and a second cap, wherein the second cap is configured to accommodate the cleaning head. The cleaning system further comprises a second cleaning tool comprising a first part acting as an engagement portion and a second part comprising a scraping surface. The first cleaning tool and the second cleaning tool are configured for cleaning different parts of the aerosol-generating device and the second cleaning tool is detachably accommodated in the first cleaning tool.

14 Claims, 8 Drawing Sheets

CLEANING TOOL WITH ADDITIONAL CLEANING ELEMENTS FOR AN AEROSOL-GENERATING DEVICE

This application is a U.S. National Stage Application of International Application No. PCT/EP2020/076054 filed Sep. 17, 2020, which was published in English on Mar. 25, 2021, as International Publication No. WO 2021/053120 A1. International Application No. PCT/EP2020/076054 claims priority to European Application No. 19198518.3 filed Sep. 20, 2019.

The present invention relates to a cleaning tool for an aerosol-generating device. In particular, the invention relates to a cleaning tool for cleaning at least a heating element of an aerosol-generating device.

Aerosol-generating articles in which an aerosol-forming substrate for generating an inhalable aerosol is heated, rather than combusted, are known in the art. Typically in such heated aerosol-generating articles, an aerosol is generated by the transfer of heat from a heat source to a physically separate aerosol-forming substrate. The aerosol-forming substrate may be located within, around or downstream of the heat source. During use, volatile compounds are released from the aerosol-forming substrate by heat transfer from the heat source and entrained in air drawn through the aerosol-generating article. As the released compounds cool, they condense to form an aerosol.

International patent application WO 2013/102614 discloses an example of an electrically operated aerosol-generating device in which an aerosol-forming substrate of an aerosol-generating article is heated in direct contact with a heating element to form an aerosol. The heating element is in the form of a blade which is inserted into an aerosol-forming substrate segment of an aerosol-generating article. It is also known to insert heating pins into such aerosol-forming substrate segments, instead of or in addition to a heating blade.

When an aerosol-forming substrate, such as a tobacco substrate, is heated, volatile compounds are released. Volatile compounds and aerosol evolved by the heat from the heating element may become deposited on the aerosol-generating device and in particular on a surface of the heating element. Particles of the aerosol-forming substrate itself may also become adhered to the heating element, particularly if the heating element is in direct contact with the aerosol-forming substrate. For example, when using the device described in international patent application WO 2013/102614, a heating blade warms a tobacco substrate to temperatures in excess of 200 degrees Celsius, releasing volatile compounds, nicotine and glycerol. However, residues and dust tend to gather inside the cavity in the device after using multiple aerosol-generating articles.

Particles and compounds adhered to and deposited on the heating element or in the cavity of an aerosol-generating device may prevent the heating element from functioning in an optimal manner. These particles and compounds may also break down during use of the aerosol-generating device and impart unpleasant or bitter flavours to a user. Therefore it is desirable to periodically clean the heating element and the cavity in which the heating element is located.

The present invention aims to solve the afore-mentioned technical problem providing an improved cleaning system for an aerosol-generating device.

According to a first embodiment of the invention the cleaning system comprises a first cleaning tool comprising a cleaning body having a cleaning head, and a housing configured to house at least part of the cleaning body. The cleaning system further comprises a second cleaning tool having a first part acting as an engagement portion and a second part comprising a scraping surface. The first cleaning tool and the second cleaning tool are configured for cleaning different parts of the aerosol-generating device. The second cleaning tool is detachably accommodated in the first cleaning tool.

As used herein the term "scraping surface" relates to any surface of the cleaning tool that is configured for scraping, caressing, brushing, swabbing or otherwise exercising a cleaning action to a surface of the aerosol-generating device.

The cleaning system according to the present invention may advantageously be used to clean different parts of the aerosol-generating device. The first cleaning tool may be formed such as to clean the main surfaces of the heating chamber or the surfaces of the heating element. The second cleaning tool may be formed such as to clean other surfaces of the heating chamber such as the bottom of a heating chamber, which may not be easily accessible with the first cleaning tool. In this way the cleaning system of the present invention allows the user to more thoroughly clean the aerosol-generating device.

The housing of the cleaning system may be formed by plural parts. Advantageously the housing is formed by a first cap and a second cap.

The first cap may accommodate at least a part of the cleaning body of the first cleaning tool of the cleaning system. The first cap may form a handle for the cleaning head of the first cleaning tool. In use of the cleaning system the first cap may be gripped by the user's hand, while the cleaning head of the first cleaning tool is engaged with the surface of the aerosol-generating device that is to be cleaned.

The second cap may be configured to engage with the first cap to form an essentially closed housing. The second cap may be configured to accommodate the cleaning head of the first cleaning tool. When the first cap and the second cap are engaged with each other, the cleaning head of the first cleaning tool of the present invention is accommodated with the housing formed by the first and second cap. In this way, the first cap and second cap at the same time efficiently protect the first cleaning tool from inadvertent damage and/or contamination when the cleaning tool is not actively used, such as during transport of the cleaning system.

The connection between the two caps and between the caps and the first cleaning tool, respectively, can be established by any connection means known to the person skilled in the art. In particular the connection can be a screw connection a friction-fit connection or a form-fit connection. The first cap may remain attached to the first cleaning tool while using the first cleaning tool to clean. The first cap may be used as a handle while using the first cleaning tool to clean. The connection between the first cap and the first cleaning tool may be such that relative rotation between these two parts is prevented. The connection means between the caps and the cleaning tool may include longitudinal grooves which engage with each other and thereby efficiently prevent relative rotation between these parts.

In an embodiment, the connection between the first cap and the second cap and the first cleaning tool can be a snap-fit connection. The first cap and the second cap may have connection features that engage with corresponding connection features of the first cleaning tool. At least one of the first and second caps may be formed from any material having a suitable module of elasticity. At least one of the first and second caps may be formed from plastic material such as elastic polymeric material. The caps may be dis-engaged from the first cleaning tool by temporarily generating increased friction between one of the caps and the cleaning tool. The cap which temporarily has lower friction with the cleaning tool may then be removed. Increase of friction can be obtained by squeezing, pushing or pressing a flexible portion of the first or the second cap. This allows easy use and reliable handling of the cleaning system.

The cleaning body of the first cleaning tool may define a recess for receiving a heating element of an aerosol-generating device. The recess may extend along the full length of the cleaning head. The recess may extend along a part of the full length of the cleaning head. The cleaning head may be provided with at least one protrusion inwardly extending or projecting into the recess of the cleaning head.

The cleaning body may be insertable into a heating chamber or cavity of an aerosol-generating device, which contains one or more heating elements, such as a heating blade or a heating pin. The cleaning body has a recess for receiving such a heating element of the aerosol-generating device. Within the cleaning head of the cleaning body there may be at least one protrusion which extends or projects into the recess.

Advantageously, by providing the first cleaning tool with at least one protrusion which extends into the recess, the first cleaning tool may be used to clean the heating element by moving the first cleaning tool relative to the heating element such that the at least one protrusion engages with the heating element, when the heating element is disposed within the recess of the first cleaning tool. The recess and the at least one protrusion can therefore form a cleaning portion of the first cleaning tool, which can be used to clean a heating element.

Preferably, the at least one protrusion is elastically deformable. This can improve the cleaning effect of the at least one protrusion. For example, this may help to increase the contact time between the at least one protrusion and the heating element during cleaning. This may also help to reduce the risk of the at least one protrusion damaging the heating element during cleaning.

The at least one protrusion is therefore preferably formed of a flexible material. The flexible material should preferably be such that when the first cleaning tool is moved within the cavity in the device, the at least one protrusion can bend while abutting the heating element, without damaging it. This bending action whilst in contact with the heating element can result in a wiping action of the heating element, and thereby remove debris from the heating element.

Preferably, the at least one protrusion comprises or is formed of one or more thermoplastic elastomers (TPE), such as one or more of Arnitel, Hytrel, Dryflex, Mediprene, Kraton, Pibiflex, Sofprene, and Laprene.

The at least one protrusion disposed within the recess may be formed of the same material as the cleaning body of the first cleaning tool. Preferably, the at least one protrusion disposed within the recess is formed of a different material than that which forms the cleaning body of the first cleaning tool. For example, the cleaning body of the first cleaning tool may be formed of a mouldable plastic and the at least one protrusion disposed within the recess may be formed of a flexible material, such as one or more thermoplastic elastomers.

The at least one protrusion disposed within the recess may be secured to the cleaning body by way of an adhesive. The at least one protrusion may be mechanically secured to the cleaning body.

The cleaning body may have any suitable shape which can enable it to be inserted into a cavity of an aerosol-generating device. Preferably, the cleaning body is substantially cylindrical. That is, preferably the cleaning body has a substantially circular cross-sectional shape. This can be advantageous for a number of reasons. For example, since most aerosol-generating articles are generally cylindrical, a cavity for an aerosol-generating device is often also generally cylindrical. By providing the first cleaning tool with a cylindrical cleaning body, the first cleaning tool can be easily located within the cavity of such aerosol-generating devices. Furthermore, the cylindrical shape of the cleaning body can help to ensure that the first cleaning tool, and in particular the first cleaning tool's at least one protrusion, is appropriately aligned with a heating element within the cavity of the device. This can help to improve the cleaning effect of the first cleaning tool. In addition, the cylindrical shape of the cleaning body can allow for the first cleaning tool to be stored and transported in a container for aerosol-generating articles. This is because the tool can occupy the space that might otherwise have been occupied by an aerosol-generating article within the container.

Preferably, the cleaning body of the first cleaning tool has a total length of between approximately 40 millimetres and approximately 60 millimetres. Preferably, the cleaning body of the first cleaning tool has a total length of approximately 50 millimetres.

Preferably, the cleaning body of the first cleaning tool has an external diameter of between approximately 6 millimetres and approximately 11 millimetres. Preferably, the cleaning body of the first cleaning tool has an external diameter of approximately 10 millimetres.

Preferably, the at least one protrusion is substantially planar. Preferably, the major dimension of the substantially planar protrusion extends along at least a portion of the length of the cleaning body. The major dimension of the substantially planar protrusion extends along a line which is parallel to the longitudinal axis of the cleaning body. A substantially planar protrusion may advantageously provide an improved cleaning effect over other cleaning objects such as brushes, because it can have an increased contact area with the heating element.

Preferably, the at least one protrusion disposed within the recess extends along at least 20 percent of the length of the cleaning body. More preferably, the at least one protrusion disposed within the recess extends along at least 30 percent of the length of the cleaning body. Preferably, the at least one protrusion disposed within the recess extends along less than 70 percent of the length of the cleaning body. By arranging for the protrusion to extend along such a length, the protrusion can be used to clean the majority or all of the length of the heating element.

Preferably, the at least one protrusion extends from a peripheral region of the cleaning body towards a radial centre of the cleaning body.

A single protrusion may be provided in the recess. Alternatively, the at least one protrusion may consist of a plurality of protrusions, each of which inwardly extends or projects into the recess. This may help to increase the cleaning efficiency of the first cleaning tool.

Preferably, the protrusions are uniformly disposed around the recess. This may help to provide a more even cleaning of a heating element disposed within the recess.

The recess may extend through the entire length of the cleaning body of the first cleaning tool. Alternatively, the recess may extend from the distal end face of the elongate body to a base within the elongate body. The base is preferably disposed between the distal end portion of the elongate body and the proximal end portion of the elongate body. The base may define the most proximal point of the recess. The base may be used to prevent the tool from being inserted too far into the cavity of an aerosol-generating device.

Where the recess extends between the distal end face of the elongate body and a base within the elongate body, and thus only extends along a part of the length of the elongate body of the tool, preferably the length of the recess is equal to at least 10 percent of the length of the elongate body. More preferably, the length of the recess is equal to at least 25 percent of the length of the elongate body. Even more preferably, the length of the recess is equal to at least 40 percent of the length of the elongate body.

With the exception of the opening at the end face of the cleaning body, the recess may be fully enclosed by the cleaning body. This means that any debris which becomes deposited in the recess during cleaning may not easily escape said recess after cleaning. This can advantageously reduce the likelihood of such debris coming into contact with the consumer or another article, after the tool has been moved away from the aerosol-generating device.

The cleaning body may include one or more openings along a side wall of the cleaning body, and the recess may extend from the end face of the cleaning body to said one or more side openings. Such side openings may help a consumer to remove debris from the recess between cleaning, if desired. For example, a consumer could blow through the recess or one of the side openings to dispel any debris from the recess after they have used the first cleaning tool. Use of such one or more side openings may also allow for the first cleaning tool to be manufactured using less material.

Advantageously, by providing a cleaning portion of the first cleaning tool within an internal region of the first cleaning tool, dirt or debris removed by the first cleaning tool during cleaning is less likely to come into contact with other objects, such as a consumer's fingers, after the first cleaning tool has been removed from the cavity of the aerosol-generating device. The first cleaning tool may therefore be handled more easily.

The cleaning system may be sized and shaped to conform to the size and shape of an aerosol-generating article. In particular, the cleaning system may be provided with a cross-sectional shape equivalent to that of an aerosol-generating article. This may allow for the cleaning system to be included within a bundle of aerosol-generating articles, when a container of aerosol-generating articles is being manufactured. This may allow for one or more cleaning systems according to the invention to be supplied to a consumer within a container of aerosol-generating articles.

Alternatively or in addition the cleaning body may comprises a scraping surface at the end face of the cleaning body. The scraping surface can allow for mechanical cleaning of surfaces within the cavity of the aerosol-generating device, and in particular, surfaces disposed at the base of the cavity. Put another way, preferably the scraping surface is configured to clean the inner surface of the cavity of the aerosol-generating device, and in particular, one or more surfaces disposed at the base of the cavity.

The first cleaning tool may therefore comprise two cleaning means for cleaning an aerosol-generating device. The first means is the at least one protrusion disposed within the recess of the tool for cleaning a heating element of the aerosol-generating device. The second means is the scraping surface disposed at the end face of the cleaning body of the first cleaning tool for cleaning a base surface of the cavity, which contains the heating element of the aerosol-generating article. Such dual cleaning means may allow to clean both a heating element and the base of a cavity of an aerosol-generating device in a single action.

The scraping surface of the first cleaning tool may be a flat or curved surface at the end face of the first cleaning tool. The scraping surface of the first cleaning tool may be a sharp tip formed by the convergence of two edges of the first cleaning tool. For example, the scraping surface may be defined by a second set of protrusions at the end face of the cleaning body. Each protrusion in the second set of protrusions may have a curved edge defining the scraping surface. Such a curved surface may be shaped to conform to a curved surface present at the base of a cavity of the aerosol-generating device.

Each protrusion in the second set of protrusions may be in the form of a tooth comprising at least two ridges extending around a recessed portion. Preferably, each tooth comprises three connected ridges, which partially surround a recessed portion. Preferably, the middle ridge has a convex leading edge, and the ridges either side of the middle ridge each have a concave leading edge.

Preferably, the second protrusions are uniformly disposed around the recess.

Preferably, the first cleaning tool comprises no more than six protrusions forming the scraping surface, more preferably no more than four protrusions forming the scraping surface. In some preferred embodiments, the plurality of protrusions forming the scraping surface consists of between 2 and 4 protrusions. In some particularly preferred embodiments, the plurality of protrusions forming the scraping surface consists of 3 protrusions.

Preferably, the scraping surface is disposed around a peripheral region of the end face of the cleaning body.

Preferably, the scraping surface is formed of a rigid material. Preferably, the scraping surface is formed of the same material as the material forming the cleaning body. Preferably, the scraping surface is formed of a plastic, such as a polyimide.

The cleaning system of the present invention comprises a second cleaning tool. The second cleaning tool is configured to clean a part or parts of the aerosol-generating device that are different form the parts of the aerosol-generating device that are cleaned by the first cleaning tool or to provide more fine-tune of cleaning capabilities on same parts.

In embodiments the second cleaning tool may have an elongate tapered either straight shape. The second cleaning tool may have the shape of a tooth pick or a needle shaped stick or a cylindrical-shaped stick. While the first tool may mainly be used for cleaning the heating element and the base surface of the heating cavity, the second tool may be used to clean the side surface of the cavity or corner areas of the base surface of the cavity or the cavity of extractor means into which the aerosol-generating articles are inserted.

The second cleaning tool may be extendable. The second cleaning tool may be telescopically extendable. In this way, in the retracted state, the second cleaning tool may be completely stored within the housing of the cleaning system. Upon use, the second cleaning tool may be brought into the extended state, in which the second cleaning tool is long enough to allow the user to reach all surfaces of the heating cavity of the aerosol-generating device for cleaning. The second cleaning tool may also be used to clean the cavity of extractor means into which the aerosol-generating articles are inserted One of the first cap and the second cap may comprise an opening through which the second cleaning tool may be inserted and extracted from the housing of the cleaning system. The shape of the opening may be adapted to the cross-sectional shape of the second cleaning tool. For example the shape of the opening may be designed such that the second cleaning tool may be frictionally held in the housing, when the second cleaning tool is fully inserted into the opening.

The second cleaning tool may comprise a first part acting as an engagement portion and a second part comprising a scraping surface. The second cleaning tool may be inserted into the opening of the housing. The second cleaning tool may be inserted with the scraping surface ahead into the opening of the housing.

When inserted into the housing, the second cleaning tool may be accessible from the outside of the housing. Preferably, the engagement portion of the second cleaning tool is accessible from the outside of the housing. In this way the caps of the cleaning system do not have to be disengaged in order to access the second cleaning tool for cleaning the aerosol-generating device. This increases usability of the cleaning system.

The engagement portion may be configured for a user to operate the second cleaning tool. The engagement portion may be provided with a gripping element that allows the user to tightly and securely grip the second cleaning tool. The gripping element may be a handle or a knob. The gripping element may generally represent an area of increased thickness at the engagement end of the second cleaning tool. The gripping element may at the same time function as a stop element and may prevent the second cleaning tool from being inserted too far into the housing of the cleaning system.

In embodiments the second cleaning tool may not be accessible from the outside of the housing, but may be stored completely within the housing of the cleaning system. In these embodiments, in order to access the second cleaning tool, the housing of the cleaning system needs to be opened before the second cleaning tool can be used.

The second cleaning tool may be detachably mounted in the inside of the housing. In more detail, the second cleaning tool may be detachably mounted to the first cap or the second cap of the housing of the cleaning system.

In order to use the second cleaning tool, the second cleaning tool may be removed from the housing and may then be used for cleaning of the aerosol-generating device.

The second cleaning tool may also be configured to be mounted to one of the parts of cleaning system. The parts of the cleaning system to which the second cleaning tool is mounted may then serve as a handle for the second cleaning tool. The engagement section may be configured to be attached to either of the first cap, the second cap and the cleaning head of the cleaning system. By using either of these parts as handles, the usability of the second cleaning tool may be increased.

At the inside of one of the caps, there may be provided a tubular support structure. The second cleaning tool may be accommodated in this tubular support structure when the housing is closed and the cleaning system is not in use. The inner diameter of the tubular support structure may correspond to the outer diameter of the second cleaning tool such that the second cleaning tool is held in position by friction. For using the second cleaning tool, the second cleaning tool may be detached from the tubular support structure. The second cleaning tool may be re-attached to the outside surface of either of the caps. In this regard, the tubular support structure may define a hollow channel that forms an opening at the end face of the corresponding cap. The opening may also have dimensions that correspond to the dimensions of the second cleaning tool. The second cleaning tool may be inserted into this opening and held in place by friction.

The tubular support structure may be configured such that it defines a through hole through the cap. The second cleaning tool may be inserted into either side of the through hole defined by the tubular support structure. When the cleaning system is not in use, the second cleaning tool is inserted from the inside into the tubular support structure. When the cleaning system is in use, the second cleaning tool may be inserted from the outside into the tubular support structure at the end face of the corresponding cap.

The second cleaning tool may be made from any suitable material. The second cleaning tool may be made from wood or polymeric material. These materials are rather soft compared to the structures of the heating cavity of the aerosol-generating device. This reduces the risk of damaging the aerosol-generating device upon cleaning.

The second cleaning tool may have a generally cylindrical shape comprising a longitudinal slit. The longitudinal slit may be configured for mounting a cleaning swab thereon. The cleaning swab may be of generally rectangular shape may have dimensions that correspond to the dimensions of the longitudinal slit. In particular, the length of the longitudinal slit may correspond to the length of the cleaning swab. In order to mount the cleaning swab in the longitudinal slit, one edge of the cleaning swab may be inserted into the longitudinal slit. Subsequently the cleaning swab may be rolled around the cylindrical portion of the second cleaning tool. In this way the cleaning swab forms a cylindrical cleaning head that may be used for cleaning the inner side of a heating chamber of an aerosol-generating device.

In embodiments the first cleaning tool may have two cleaning heads on opposite ends of the cleaning body. The second cleaning head may be identical to the first cleaning head described above. The second cleaning head may also have a different structure than the first cleaning head. For example, the second cleaning head may have the form of a brush.

The second cleaning head may have the form of a cotton tip. The cotton tip may have a special shape that conforms to the heating chamber that is to be cleaned. The cotton tip may further be impregnated by a solvent such as isopropanol. This may facilitate cleaning of the heating chamber of the aerosol-generating device.

The brush may be permanently fixed to the cleaning body or may be detachable from the cleaning body. When the brush is detachable from the cleaning body, the brush may be formed to have two ends with different brush configurations. The second cleaning head may also be formed to have one end configured as a brush and one end configured as a cotton tip.

The user can choose which of the cleaning heads should be used. The first cap and the second cap of the housing of the cleaning system, as well as their connection is designed such that both the first cap and the second cap are removable from the first cleaning tool. This is achieved by manufacturing both caps from sufficiently elastic material that may be pressed or pushed to change the friction between the caps and the first cleaning tool.

By removing the first cap from the cleaning system, the user may expose the first cleaning head of the first cleaning tool. The second cap remains fixed to the first cleaning tool and may form a handle portion for using the first cleaning head of the first cleaning tool.

By removing the second cap from the cleaning system, the user may expose the second cleaning head of the first cleaning tool. In this case, the first cap remains fixed to the first cleaning tool and forms a handle portion for using the second cleaning head of the first cleaning tool.

The second cleaning tool may be comprised in either of the caps. In the embodiments in which the second cleaning tool is completely comprised within the housing, it is particularly advantageous to configure the second cleaning tool as an extendable cleaning tool. Independent from the available space within the housing, the cleaning tool can be extended to the required length for cleaning. The cleaning tool may have retention means for keeping the cleaning tool in its extended configuration. In this configuration the cleaning tool may be used for cleaning. After cleaning the retention means may be released by a user to get the cleaning tool back in its contracted position.

The second cleaning tool can be used as stand-alone element. The second cleaning tool may also be attached to one of the caps. In this way, the cap may form a handle portion which may make handling and use of the second cleaning tool easier.

Features described in relation to one embodiment may equally be applied to other embodiments of the invention.

The invention will be further described, by way of example only, with reference to the accompanying drawings in which:

FIG. 1 shows a first embodiment of a cleaning system of the present invention;

FIG. 2 schematically shows a cleaning head of the first cleaning tool;

Figure 1:
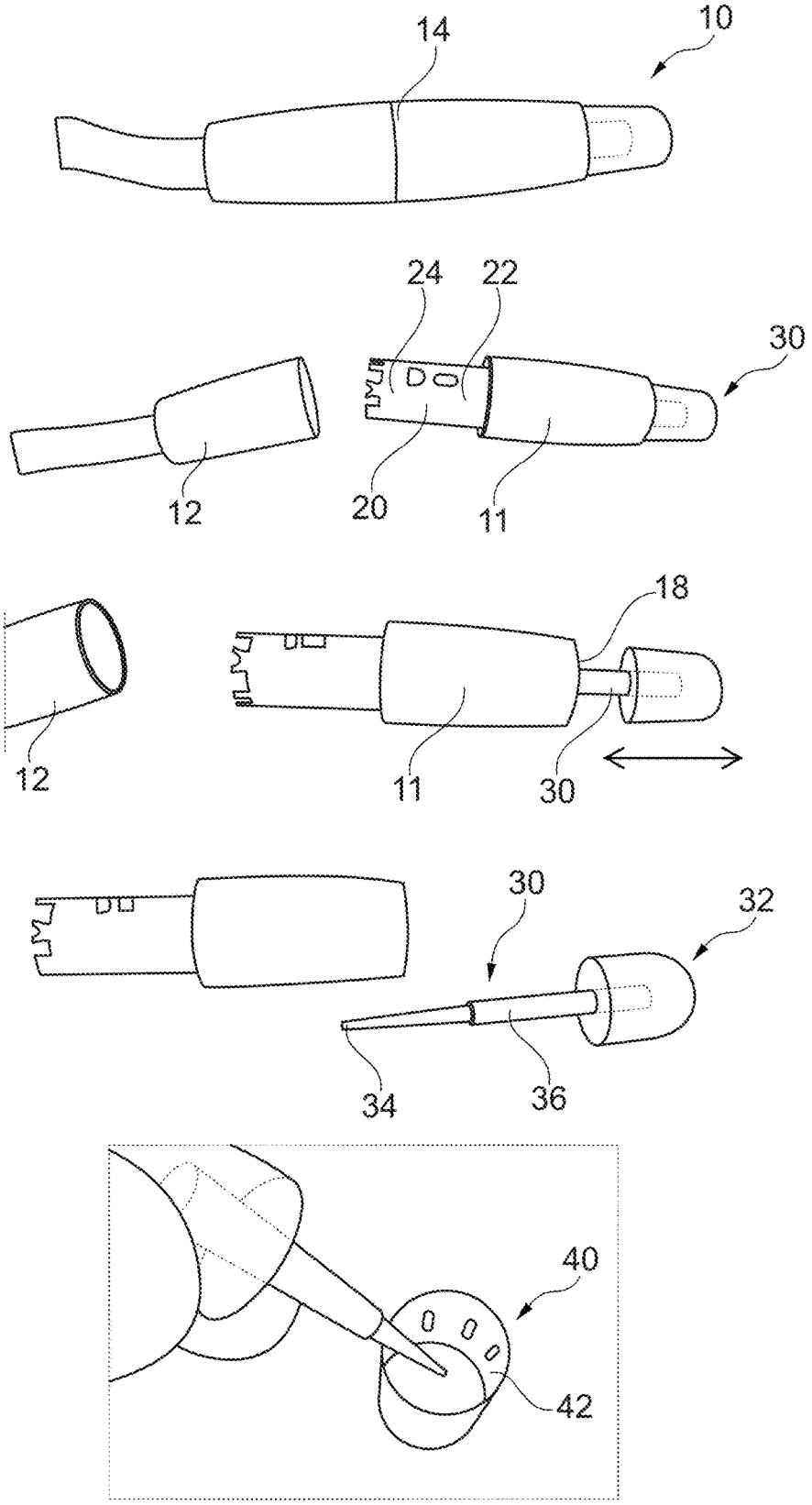

FIG. 1 shows a first embodiment of a cleaning system 10 in accordance with the present invention. The cleaning system 10 comprises a first cap 11 and a second cap 12. The cleaning system 10 further comprises a first cleaning tool 20 and a second cleaning tool 30.

In the uppermost view of FIG. 1 all elements of the cleaning system 10 are assembled together and the first cap 11 and the second cap 12 form a closed housing 14 of the cleaning system 10. The second cap 12 can be removed to expose the first cleaning tool 20. The first cleaning tool comprises a cleaning body 22 and a cleaning head 24. The first cap 11 remains attached to the first cleaning tool 20 and forms a handle for using the cleaning head 24 of the first cleaning tool 20. At least the part of the cleaning body 22 of the first cleaning tool 20 is located within the first cap 11.

The cleaning head 24 of the first cleaning tool 20 is made from polymeric material and defines a recess for receiving a heating element of an aerosol-generating device 40. Cleaning head 24 is provided with three protrusions inwardly extending or projecting into the recess of the cleaning head 24. The cleaning head 24 of the first cleaning tool 20 is described in more detail below with reference to FIG. 2.

The second cleaning tool 30 is detachably accommodated in the first cleaning tool 20. The first cap 11 has an opening (not depicted) at its end face 18. The second cleaning tool 30 can be inserted via the opening into cap 11 and into the cleaning body 22 of the first cleaning tool 20 as depicted in the middle view of FIG. 1.

In the fourth view of FIG. 1, the second cleaning tool 30 is completely removed from the remaining parts of the cleaning system 10. The second cleaning tool 30 has an elongate, tapered shape and comprises an engagement portion 32. In this embodiment the cleaning head 34 of the second cleaning tool 30 is a tapered stick made from polymeric material.

The cleaning head 34 is mounted to the engagement portion 32 via a cylindrical mounting portion 36 having an increased diameter.

The engagement portion 32 is accessible from the outside of the housing 14. Thus, the second cleaning tool 30 can be retracted for use by pulling at engagement portion 32 without any need to open the housing 14.

As indicated in the bottom view of FIG. 1, the second cleaning tool 30 may be used to clean the bottom or side surfaces of a heating chamber 42 of an aerosol-generating device 40.

Figure 2:
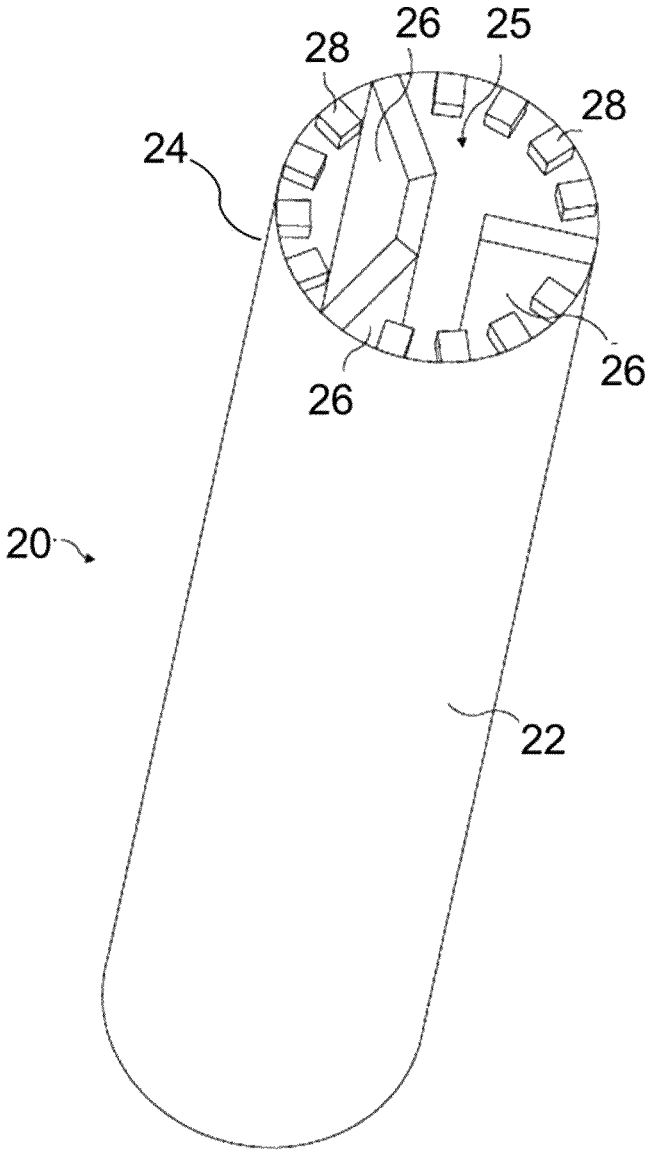

FIG. 2 shows a perspective schematic view of the first cleaning tool 20 depicted in FIG. 1 The first cleaning tool 20 comprises an elongate cleaning body 22 having a generally cylindrical shape. The cleaning head 24 defines a recess 25 for receiving a heating element of an aerosol-generating device.

The cleaning head 24 comprises a first set of protrusions 26. Each of these protrusions 26 extend into a central region of the recess 25. In the embodiment of FIG. 2, three such protrusions 26 are provided, with said protrusions 26 being uniformly spaced around the recess 25.

When the cleaning tool of FIG. 2 is in use, a heating element can be inserted into the recess 25 such that at least a portion of the length of the heating element extends along at least a portion of the length of the recess 25. The cleaning tool 20 can then be moved relative to the heating element, for example by rotating the cleaning tool 20 relative to the heating element. Such rotational movement can cause debris being removed from the surface of the heating element.

The cleaning head 24 comprises also a second set of protrusions 28. These protrusions 28 are disposed around the peripheral region of the cleaning head 24, with each of said protrusions 28 extending towards the central region of the cleaning head 24. In the embodiment of FIG. 2, twelve such protrusions 28 are provided, with said protrusions 28 being uniformly spaced around the recess 25.

The protrusions 28 are smaller than the protrusions 26. The second protrusions 28 are preferably formed of a rigid material, such as a polyimide. The first protrusions 26 are preferably formed of a flexible material, such as a thermoplastic elastomer. In the embodiment of FIG. 2, the second protrusions 28 are formed integrally with the elongate cleaning body 22.

The second protrusions 28 can together form a scraping surface, which can be used to provide a different cleaning function from that of the first protrusions 26. In particular, the second protrusions 28 can be used to clean the base of a cavity which contains a heating element of an aerosol-generating device. The cleaning function of the second protrusions 28 can be initiated by movement of the cleaning tool 20 relative to the cavity and heating element. Such movement may be a rotational movement.

Figure 3:
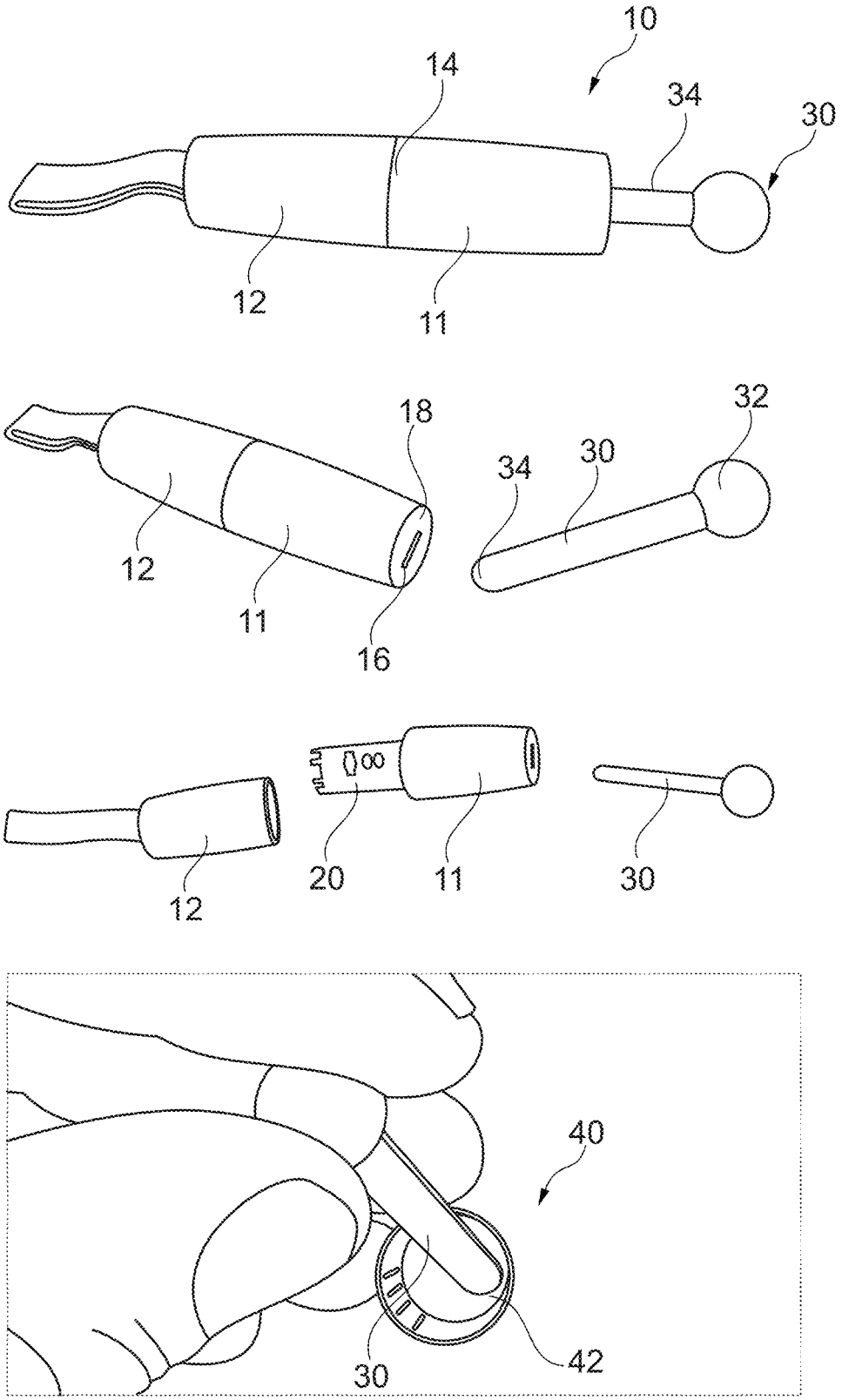
FIG. 3 shows a cleaning system with a second cleaning tool in the form of a wooden stick.

In FIG. 3 a further embodiment of the cleaning system 10 of the present invention is depicted. The first cap 11 and the second cap 12 form a closed housing 14 for the first cleaning tool 20.

The second cleaning tool 30 is again detachably accommodated in the first cleaning tool 20. The first cap 11 has an opening 16 at its end face 18. The second cleaning tool 20 can be inserted and detached from the first cleaning tool 20 via opening 16 of the first cap 11, as indicated by the arrow depicted in the top view of FIG. 3.

In the second view of FIG. 3, the second cleaning tool 30 is completely extracted and detached from the first cleaning tool 20. The second cleaning tool 30 has an engagement portion 32 in the form of a knob made from polymeric material.

The second cleaning tool 30 has an elongate, tapered shape. The cleaning head 34 of the second cleaning tool 30 is an elongated element with a rounded end acting as scraping surface. The cleaning head 34 of the second cleaning tool 30 is made from wood.

The third view of FIG. 3 shows all elements of the cleaning system 10 in a disassembled state: the second cap 12, the first cap 11 with the first cleaning tool 20, and the second cleaning tool 30.

The bottom view of FIG. 3 shows how the second cleaning tool 30 may be used for cleaning the heating chamber 42 of an aerosol generating device 40.

Figure 4:
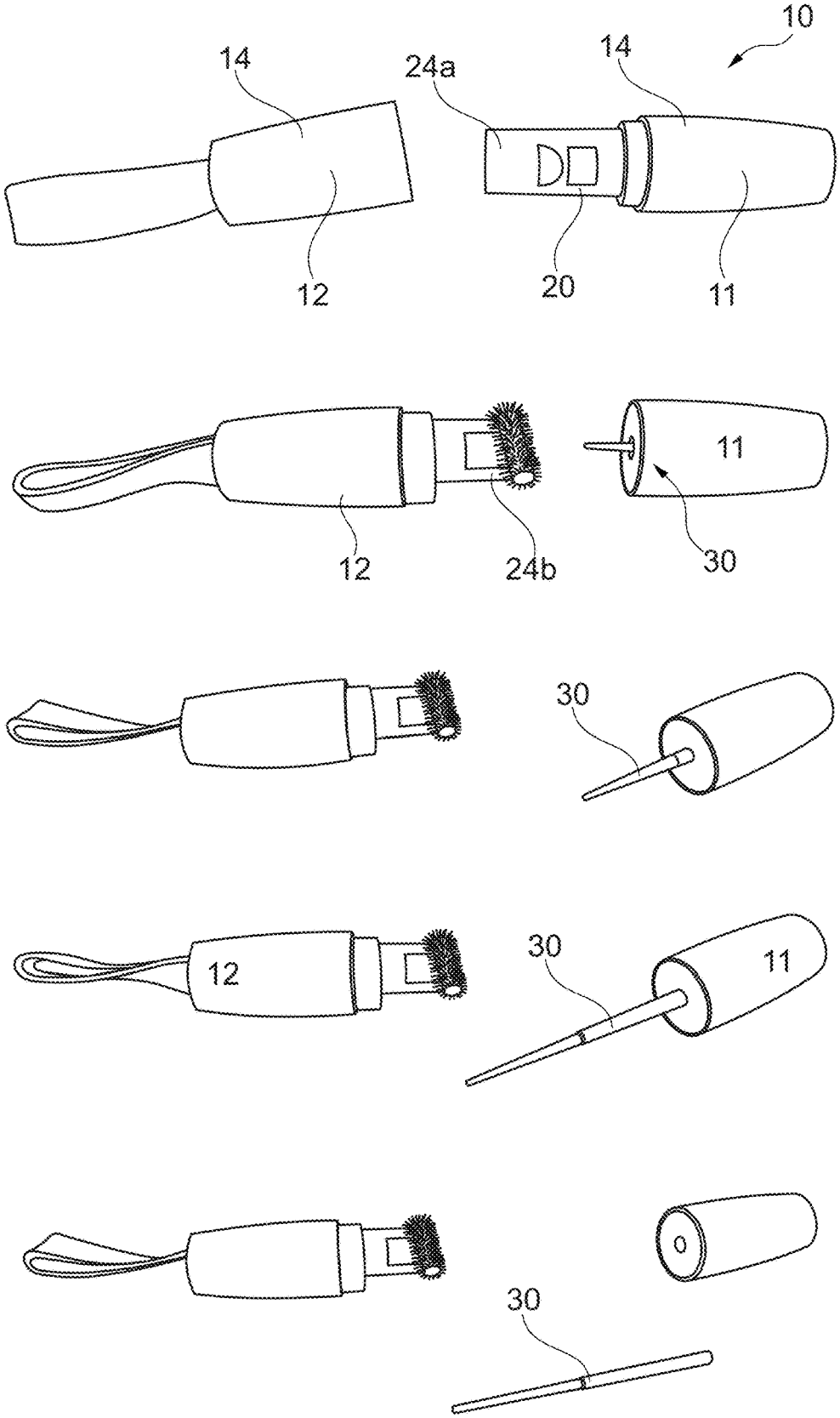
FIG. 4 shows a cleaning system wherein the second cleaning tool is accommodated within the housing.

FIG. 4 shows a further embodiment of the cleaning system 10 of the present invention. In this embodiment the first cleaning tool 20 comprises two cleaning heads 24*a*, 24*b* and the second cleaning tool 30 is completely accommodated within the housing 14. Thus, in this embodiment the second cleaning tool 30 is not accessible from the outside. Instead, in order to access the second cleaning tool 30, the first cap 11 and the second cap 12 have to be separated from each other.

In the configuration shown in the top view of FIG. 4 the second cap 12 is removed and the first cleaning tool 20 is attached to the first cap 11. In this configuration the first cleaning head 24*a* of the first cleaning tool 20 is exposed. This first cleaning head 24*a* corresponds to the cleaning heads 24 of the first cleaning tool as depicted in FIGS. 1 to 3.

As depicted in the second view of FIG. 4, the housing 14 is configured such that also the second cap 12 may remain attached to the first cleaning tool 20 while the first cap 11 may be removed. Both caps 11, 12 are made from the same material and form a snap-fit connection with the first cleaning tool 20. Either cap 11, 12 can be removed from the first cleaning tool 20 by pressing one cap 12, 11 and pulling the respective other cap 11, 12.

In the second view of FIG. 4 the second cleaning head 24*b* of the first cleaning tool 20 is exposed. The second cleaning head 24*b* of the first cleaning tool 10 has the form of a brush and is also useful for cleaning the heating chamber or the heating element of an aerosol-generating device.

In addition, in the second cap 12 of the cleaning system 10 the second cleaning tool 30 is accommodated. The second cleaning tool 30 is similar to the second cleaning tool 30 depicted in FIG. 1 and is a polymeric elongate stick with a tapered shape. In this embodiment the second cleaning tool 30 is telescopically extendible. In the contracted state the second cleaning tool 30 is sufficiently short, so that it is accommodated within the first cleaning tool 20 when the housing is closed. In the extended state the second cleaning tool 30 is sufficiently long so that it can be efficiently used to clean the heating chamber, including the bottom of the heating chamber, of an aerosol generating device. The second cleaning tool 30 may also be used for cleaning the inside and the bottom of any supporting structure that is used for facilitating insertion of the aerosol-generating article.

As depicted in the lowermost views of FIG. 4 the second cleaning tool 30 may be used as a stand-alone tool. Alternatively the second cleaning tool 30 may also remain attached to the first cap 11. In the latter configuration, the first cap 11 may form a handle to make handling of the second cleaning tool 30 easier.

Figure 5:
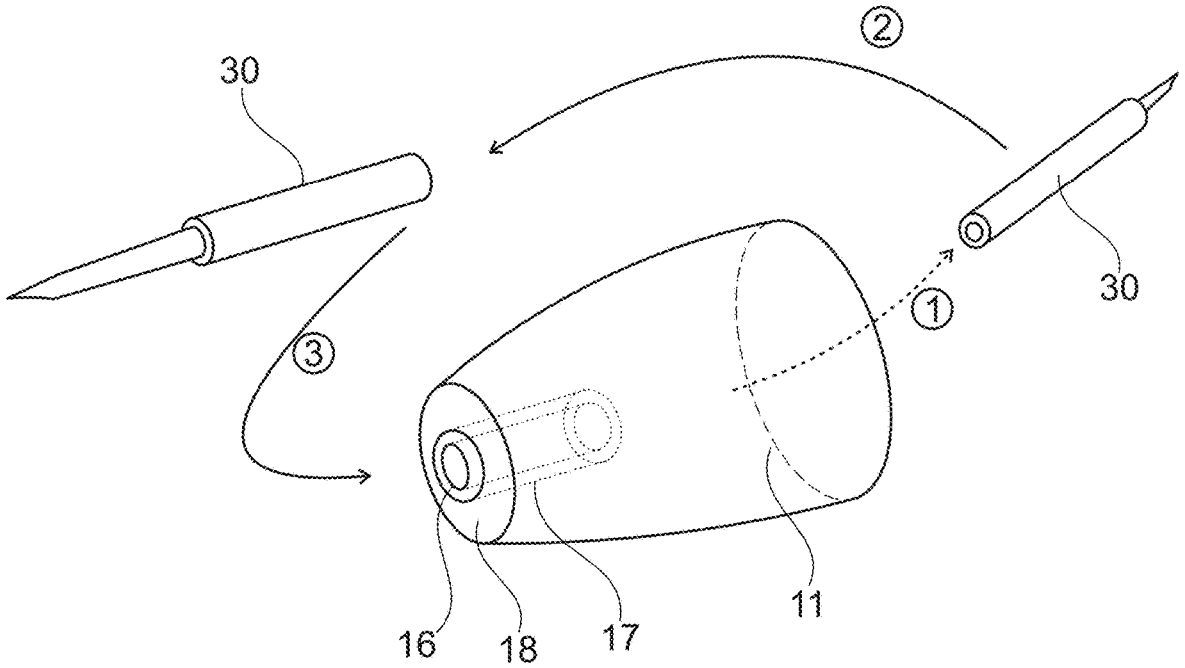
FIG. 5 shows a modification to the cleaning system of FIG. 4.
Figure 5:
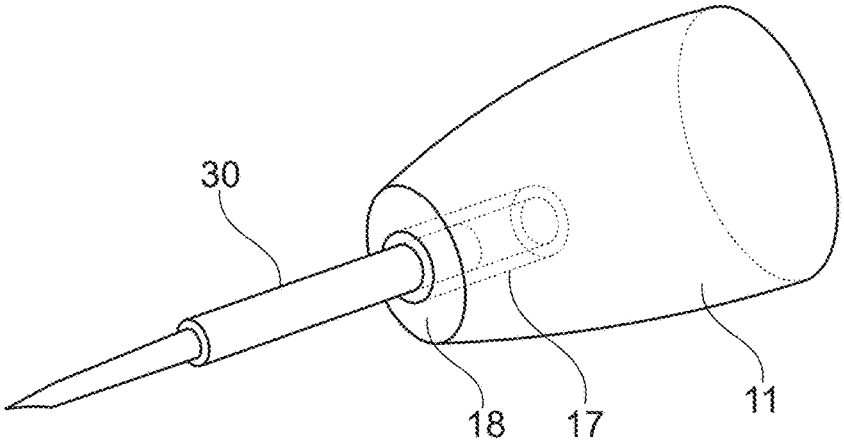

FIG. 5 shows a modification of the cleaning system 10 of FIG. 4. The second cleaning tool 30 is accommodated in a tubular support structure 17 provided in the first cap 11. The tubular support structure 17 extends from end face 18 into the inner volume of the first cap 11. One end of the tubular support structure 17 forms opening 16 at the end face 18 of the first cap 11. The inner diameter of the tubular support structure corresponds to the outer diameter of the second cleaning tool 30 and holds the second cleaning tool in position by friction.

As indicated in FIG. 5 the second cleaning tool 30 can be made ready for use in only three steps. In a first step the second cleaning tool 30 is detached from the tubular support structure 17 of the first cap 11. In a second step the second cleaning tool 30 is rotated by 180 degrees and is transferred to the outer end face 18 of the first cap 11. In a third step the second cleaning tool 30 is plugged from the outside into the opening 16 of the end face 18 of the first cap 11. In this way, the first cap may form a handle to make handling of the second cleaning tool 30 easier. The bottom view of FIG. 5 shows the second cleaning tool of the embodiment of FIG. 5 in a ready to use configuration.

Figure 6:
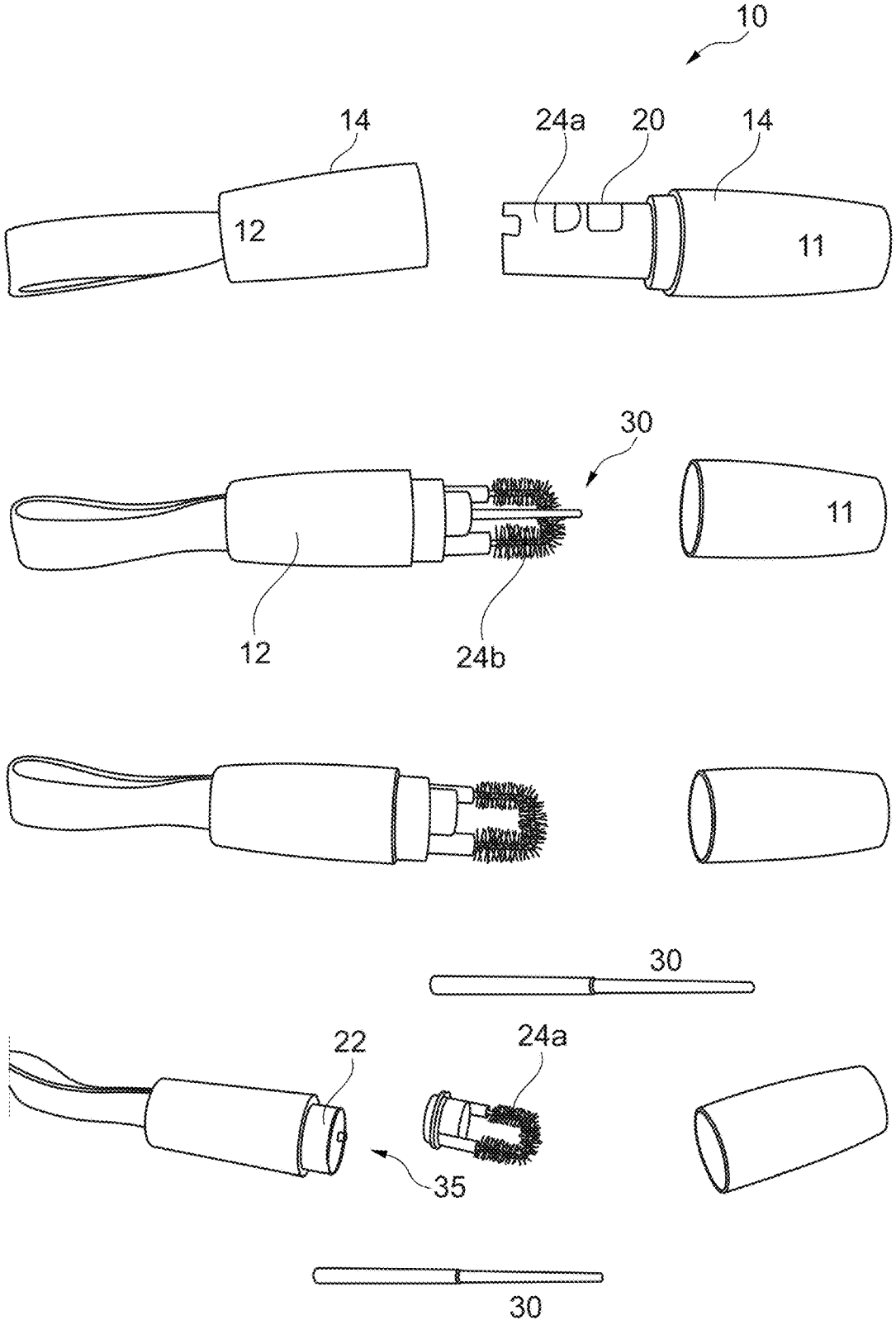
FIG. 6 shows a cleaning system with the first cleaning tool comprising two cleaning heads.

FIG. 6 shows a modification of the cleaning system 10 of FIG. 4. The second cleaning tool 30 is completely accommodated in the housing 14 of the cleaning system 10 and the first cleaning tool 20 comprises two cleaning heads 24*a*, 24*b* at opposite ends of the cleaning body 22. In contrast to the embodiment of FIG. 4, the second cleaning tool 30 is not attached to the first cap 11, but is accommodated in the centre of and coupled to the first cleaning tool 20. The second cleaning tool 30 is configured as a telescopic element and can be completely extracted from the first cleaning tool 20. This is depicted in the third view of FIG. 6.

The second cleaning head 24*b* of the first cleaning tool 10 comprises a brush. As depicted in the bottom view of FIG. 6, the second cleaning head 30 is configured to be removable from the first cleaning tool 20. The second cleaning tool 20 may then be re-inserted into a connection sleeve 35 of the first cleaning tool 20. In this way, the second cap 12 and the remaining portion of the first cleaning tool 20 may serve as a handle for the second cleaning tool 30. Alternatively, similar as shown in FIG. 5 the second cleaning head 30 may be re-inserted from the outside in the opening on the end face of cap 11 which may then serve as a handle for the second cleaning tool 30.

Figure 7:
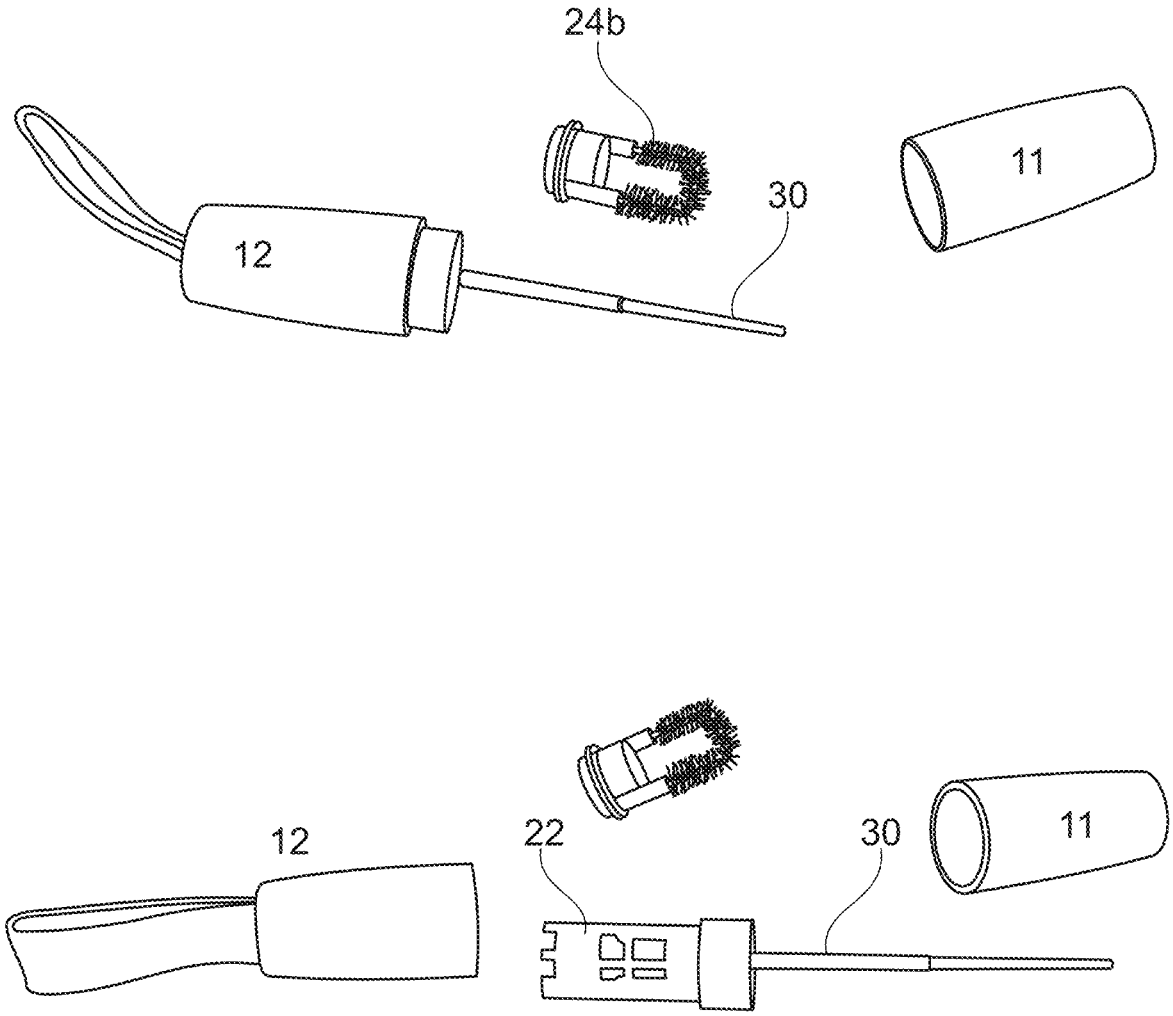
FIG. 7 shows details of a first cleaning tool comprising a brush.

As depicted in FIG. 7, once the second cleaning tool 30 has been re-inserted into the connection sleeve 35, the first cap 11 may also be removed. In this configuration the remaining cleaning body 22 of the first cleaning tool 20 forms the handle for maneuvering the second cleaning tool 30.

Figure 8:
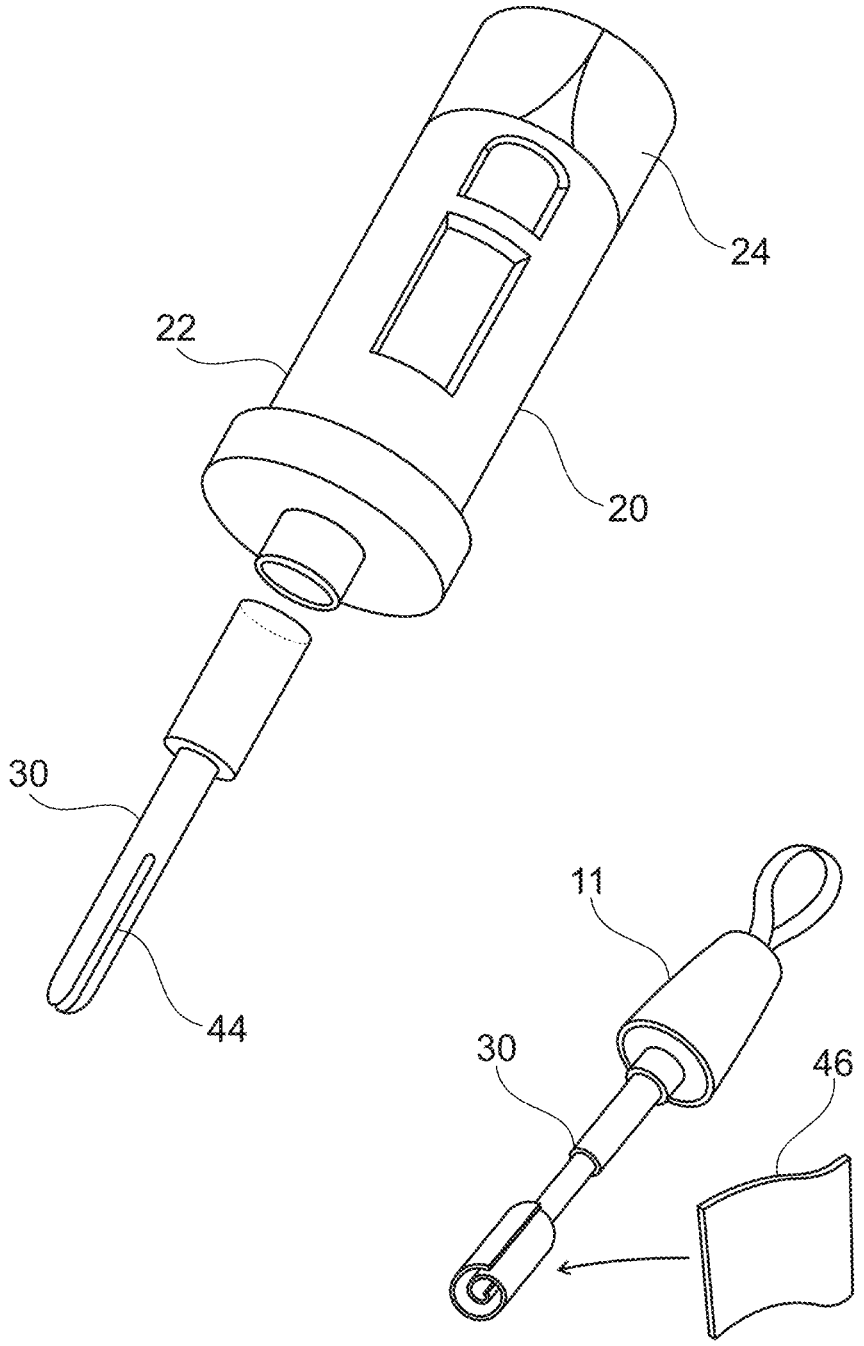
FIG. 8 shows a further embodiment of a second cleaning tool.

FIG. 8 shows a further embodiment of a cleaning system 10 according to the present invention. The first cleaning tool is similar to the first cleaning tool as described above in relation to the embodiment of FIG. 1.

The second cleaning tool 30 is an extendible element having a generally cylindrical shape. The second cleaning tool 30 is detachable from the first cleaning tool 20. The cylindrical portion of the second cleaning tool 30 comprises a longitudinal slit 44. A cleaning swab 46 is to be mounted in the longitudinal slit. The cleaning swap 46 is of generally rectangular shape and has a length that corresponds to the length of the longitudinal slit 44. In order to mount the cleaning swap in the longitudinal slit, one edge of the cleaning swab is inserted into the slit. Subsequently the cleaning swab is rolled around the cylindrical portion of the second cleaning tool 30. In this way the cleaning swap forms a cylindrical cleaning head that may be used for cleaning the inner side of a heating chamber of an aerosol-generating device.

As depicted in FIG. 8 the cleaning body of the first cleaning tool 20 may form a handle for the second cleaning tool 30. Alternatively, the second cleaning tool 30 may also be inserted from the outside into an opening provided at an end surface of the first cap as described in relation with the embodiment of FIG. 5.

The invention claimed is:

1. A cleaning system for an aerosol-generating device, the cleaning system comprising:

a first cleaning tool comprising a cleaning body having a cleaning head, and a housing configured to house at least part of the cleaning body, wherein the housing is formed by a first cap and a second cap, wherein the second cap is configured to accommodate the cleaning head and a second cleaning tool comprising a first part acting as an engagement portion and a second part comprising a scraping surface, wherein the first cleaning tool and the second cleaning tool are configured for cleaning different parts of the aerosol-generating device and the second cleaning tool is detachably accommodated in the first cleaning tool.

2. A cleaning system according to claim 1, wherein the first cap accommodates part of the cleaning body such that the first cap forms a handle for the cleaning head.

3. A cleaning system according to claim 1, wherein the second cleaning tool is an elongate tapered shape.

4. A cleaning system according to claim 1, wherein the second cleaning tool is telescopically extendable.

5. A cleaning system according to claim 1, wherein one of the first cap and the second cap comprises an opening for the second cleaning tool to be inserted and extracted.

6. A cleaning system according to claim 5, wherein the second part of the second cleaning tool is inserted into the housing through the opening.

7. A cleaning system according to claim 1, wherein the second cleaning tool is accessible from the outside of the housing.

8. A cleaning system according to claim 7, wherein the engagement portion is accessible from the outside of the housing.

9. A cleaning system according to claim 8, wherein the engagement portion is provided with a knob.

10. A cleaning system according to claim 1, wherein the second cleaning tool is enclosed within the housing of the first cleaning tool.

11. A cleaning system according to claim 10, wherein the second cleaning tool is detachably mounted in the inside of the housing.

12. A cleaning system according to claim 10, wherein the second cleaning tool is configured to be mounted to the cleaning head of the first cleaning tool.

13. A cleaning system according to claim 1, wherein the first cleaning tool comprises two cleaning heads.

14. A cleaning system according to claim 13, wherein one of the cleaning heads of the first cleaning tool is detachable from the first cleaning tool.

* * * * *